US009074139B2

(12) United States Patent
Quignard et al.

(10) Patent No.: US 9,074,139 B2
(45) Date of Patent: Jul. 7, 2015

(54) PROCESS FOR COAL CONVERSION COMPRISING AT LEAST ONE STEP OF LIQUEFACTION FOR THE MANUFACTURE OF AROMATICS

(71) Applicant: IFP ENERGIES NOUVELLES, Rueil-Malmaison Cedex (FR)

(72) Inventors: Alain Quignard, Roussillon (FR); Eric Sanchez, Saint Genis Laval (FR); Jean Francois Le Coz, Saint German en Laye (FR)

(73) Assignee: IFP ENERGIES NOUVELLES, Rueil-Malmaison Cedex (FR)

( * ) Notice: Subject to any disclaimer, the term of this patent is extended or adjusted under 35 U.S.C. 154(b) by 158 days.

(21) Appl. No.: 13/706,713

(22) Filed: Dec. 6, 2012

(65) Prior Publication Data

US 2013/0146508 A1 Jun. 13, 2013

(30) Foreign Application Priority Data

Dec. 7, 2011 (FR) ..... 11 03753
Dec. 7, 2011 (FR) ..... 11 03757

(51) Int. Cl.

| | |
|---|---|
| ***C10G 1/08*** | (2006.01) |
| ***C10G 65/12*** | (2006.01) |
| ***C10G 35/04*** | (2006.01) |
| ***C10G 47/02*** | (2006.01) |
| ***C10G 1/00*** | (2006.01) |
| ***C10G 49/00*** | (2006.01) |
| ***C10G 63/00*** | (2006.01) |
| ***C10G 63/04*** | (2006.01) |

(Continued)

(52) U.S. Cl.

CPC ..... *C10G 1/006* (2013.01); *C10G 35/04* (2013.01); *C10G 47/02* (2013.01); *C10G 49/002* (2013.01); *C10G 63/00* (2013.01); *C10G 63/04* (2013.01); *C10L 1/04* (2013.01); *C10L 1/06* (2013.01); *C10L 1/08* (2013.01); *C10G 1/002* (2013.01); *C10G 1/06* (2013.01); *C10G 1/08* (2013.01); *C10G 2400/20* (2013.01); *C10G 2400/30* (2013.01)

(58) Field of Classification Search

CPC ..... C10G 1/002; C10G 1/006; C10G 1/06; C10G 1/08; C10G 2400/20; C10G 2400/30; C10G 35/04; C10G 47/02; C10G 49/002; C10G 63/00; C10G 63/04

USPC ..... 208/49, 413; 585/319

See application file for complete search history.

(56) References Cited

U.S. PATENT DOCUMENTS 3,714,033 A * 1/1973 Somekh et al. ..... 208/321
4,045,329 A 8/1977 Johanson et al.

(Continued)

OTHER PUBLICATIONS

Parkash, S, Refining Processes Handbook, 2003, Gulf Publishing, pp. 109-113 & 136-143.*

(Continued)

*Primary Examiner* — Walter D Griffin
*Assistant Examiner* — Derek Mueller
(74) *Attorney, Agent, or Firm* — Millen, White, Zelano & Branigan, P.C.

(57) ABSTRACT

The invention relates to a process for coal conversion, optionally in co-processing with other feedstocks, notably of the biomass type, comprising at least one liquefaction step, followed by a fixed-bed hydrocracking step and a catalytic reforming step. With this process, aromatic compounds can be obtained from a feedstock containing coal.

15 Claims, 2 Drawing Sheets

(51) Int. Cl.

| | |
|---|---|
| ***C10L 1/04*** | (2006.01) |
| ***C10L 1/06*** | (2006.01) |
| ***C10L 1/08*** | (2006.01) |
| ***C10G 1/06*** | (2006.01) |

(56) References Cited

U.S. PATENT DOCUMENTS

| | | | | |
|---|---|---|---|---|
| 4,217,112 | A | 8/1980 | Johanson | |
| 4,495,055 | A | 1/1985 | Comolli et al. | |
| 4,569,749 | A | 2/1986 | Wright | |
| 4,599,479 | A * | 7/1986 | Okamoto et al. | 585/648 |
| 4,689,139 | A | 8/1987 | Wurfel | |
| 2011/0230688 | A1 * | 9/2011 | Charon et al. | 585/240 |

OTHER PUBLICATIONS

Search Report of FR 1103757 (May 25, 2012).

W. D. Constant et al., "Hydrocracking of Model Coal-Derived Liquid Components over a Zeolite Catalyst", Fuel, vol. 65 (1986) pp. 8-16.

D. Storm et al., "Modelling of Catalytic Coal Hydrogenation in a Bubble Column Reactor: 2. Model Calculations of Bubble Column Cascades", Fuel, vol. 71 (1992) pp. 681-688.

A. A. Krichko et al., "Production of Engine Fuels from Coals of the Kansk-Achinsk Basin", Chemistry and Technology of Fuels and Oils, vol. 20, No. 3 (1984) pp. 113-117.

A. Y. Grozshtein et al., "Catalytic Reforming of Naphtha from Liquefaction of Coal Produced in the Kansko-Achinsk Basin", Chemistry and Technology of Fuels and Oils, vol. 21, No. 7 (1985) pp. 336-338.

* cited by examiner

PROCESS FOR COAL CONVERSION COMPRISING AT LEAST ONE STEP OF LIQUEFACTION FOR THE MANUFACTURE OF AROMATICS

The present invention relates to a process for producing aromatic compounds from coal, optionally in co-processing with other feedstocks, notably of the biomass type. More precisely, the present invention relates to a process for coal conversion comprising at least one liquefaction step, followed by a fixed-bed hydrocracking step of suitable severity to maximize the production of precursors of light aromatics and a catalytic reforming step. The process according to the invention also makes it possible to obtain middle distillates.

The aromatic compounds, in particular benzene, toluene and the xylenes (BTX), are building-block chemicals in petrochemistry, for the synthesis of resins, plasticizers and polyester fibres.

The main source of production of BTX is catalytic reforming, which is used by refiners for improving the octane number of gasoline by the manufacture of aromatics. This process produces, from naphtha, a cut that is rich in aromatic hydrocarbons called reformate, from which the aromatics can be extracted, separated and transformed.

The production of aromatics is currently based essentially on a petroleum origin. The present international context is characterized by a desire to reduce dependence on raw materials of petroleum origin. In this context, finding new feedstocks derived from non-petroleum sources constitutes an increasingly important challenge.

In view of the abundant coal reserves, an attractive alternative for the production of intermediates in petrochemistry is coal liquefaction.

The production of fuel bases by direct liquefaction of coal is known. Thus, application FR 2957607 describes a process for direct liquefaction of coal in two successive steps using ebullating bed reactors followed by a hydrocracking step. This process allows fuel bases to be obtained (diesel and kerosene) complying with the required specifications despite a high content of naphtheno-aromatics and more particularly of naphthenes.

The present invention aims to produce aromatic compounds of the BTX type from coal, using a process comprising a liquefaction step, followed by a hydrocracking and catalytic reforming step.

More particularly, the present invention relates to a process for conversion of coal to aromatic compounds comprising the following steps:

a) a coal liquefaction step in the presence of hydrogen, b) a step of separation of the effluent obtained at the end of step a) into a light fraction of hydrocarbons containing compounds boiling at most at 500° C. and a residual fraction, c) a hydrocracking step, in the presence of hydrogen, of at least a proportion of the so-called light fraction of hydrocarbons obtained at the end of step b) in at least one reactor containing a fixed-bed hydrocracking catalyst, the conversion of the 200° C.$^+$ fraction in the hydrocracking step being greater than 30 wt %, preferably between 50 and 100 wt %, d) separation of the effluent obtained at the end of step c) into at least a fraction containing naphtha and a fraction heavier than the naphtha fraction, e) a catalytic reforming step of the fraction containing naphtha, giving hydrogen and a reformate containing aromatic compounds, f) a step of separation of the aromatic compounds from the reformate.

The research work carried out by the applicant on coal liquefaction led him to discover that, surprisingly, this process of coal liquefaction followed by a fixed-bed hydrocracking step made it possible to obtain, after separation, a naphtha fraction that is particularly suitable on account of its chemical nature and its very small amount of impurities, for the production of aromatic compounds by catalytic reforming. In fact, the naphtha leaving the liquefaction and hydrocracking has a very high content of naphthenes (50 to 90 wt %) and at the same time has a very low content of impurities (generally less than 0.5 ppm of sulphur and less than 0.5 ppm of nitrogen) so that it can be sent directly to catalytic reforming without any pretreatment. Its unique structure endows it with excellent reactivity with respect to aromatization reactions.

The liquefaction step makes it possible to obtain, firstly, hydrocarbons that still have a high content of impurities: heteroelements of sulphur, nitrogen and oxygen as well as olefins and polyaromatics. Before sending the light fraction (naphtha) of these hydrocarbons to catalytic reforming, it is thus necessary to carry out a severe hydrocracking step. This hydrocracking step thus makes it possible to obtain, by cracking, a large naphtha fraction and heavier hydrocarbon fractions (gas oil and vacuum gas oil, essentially), but also to remove, by deep hydrotreating, all the impurities so as not to poison the sensitive catalysts of the subsequent catalytic reforming.

Moreover, the severity of the hydrocracking step makes it possible to increase the yield of naphtha fraction (at the expense of the middle distillates, gas oil essentially) and therefore finally increase the yield of aromatics and of hydrogen produced during reforming.

DETAILED DESCRIPTION

The description will be given referring to FIGS. 1 and 2, without the figures limiting the interpretation.

The Feedstock

The feedstock used comprises coal, preferably of the bituminous or subbituminous type. However, lignites can also be used.

The liquefaction technology also allows coal conversion to be carried out in co-processing with other feedstocks. The coal can be co-processed with a feedstock selected from petroleum residues, vacuum distillates of petroleum origin, crude oils, synthetic crudes, topped crudes, deasphalted oils, resins from deasphalting, asphalts or tars from deasphalting, derivatives from petroleum conversion processes, aromatic extracts obtained from the production chains of bases for lubricants, bituminous sands or derivatives thereof, oil shale or derivatives thereof, or mixtures of these feedstocks. More generally, the term hydrocarbon feedstocks from petroleum will cover hydrocarbon feedstocks containing at least 50 wt % of product distilling above 250° C. and at least 25 wt % distilling above 350° C.

Coal can also be co-processed with hydrocarbon wastes and/or industrial polymers, organic wastes or household plastics, vegetable or animal oils and fats, tars and residues that cannot be upgraded or are difficult to upgrade resulting from the gasification and/or Fischer-Tropsch synthesis of biomass, coal or petroleum residues, lignocellulosic biomass or one or more constituents of cellulosic biomass selected from the group comprising cellulose, hemicellulose and/or lignin, algae, charcoal, oil from pyrolysis of lignocellulosic biomass or algae, pyrolytic lignin, products from hydrothermal conversion of lignocellulosic biomass or algae, activated sludge from water treatment works, or mixtures of these feedstocks.

In the case of co-processing with a feedstock of the biomass type, the latter can be selected from algae, lignocellulosic biomass and/or one or more constituents of lignocellulosic biomass selected from the group comprising cellulose, hemicellulose and/or lignin.

Lignocellulosic biomass consists essentially of three natural polymers: cellulose, hemicellulose and lignin. It generally contains impurities (sulphur, nitrogen, etc.) and various kinds of inorganic compounds (alkaline, transition-metal, halogen, etc.).

Lignocellulosic biomass can consist of wood or vegetable wastes. Other non-limiting examples of lignocellulosic biomass material are agricultural residues (straw, etc.), forestry residues (products from first thinning), forestry products, dedicated crops (short rotation coppice), food industry residues, household organic waste, waste from woodworking installations, used wood from construction, paper, whether or not recycled. The lignocellulosic biomass can also be derived from by-products of the papermaking industry such as kraft lignin, or black liquor from pulp manufacture.

The algae usable in liquefaction are macroalgae and/or microalgae. Thus, the feedstock can consist of prokaryotic organisms such as blue-green algae or cyanobacteria, or eukaryotic organisms such as groups with unicellular species (Euglenophyta, Cryptophyta, Haptophyta, Glaucophyta, etc.), groups with unicellular or multicellular species such as red algae or Rhodophyta, and Stramenopila notably including the diatoms and brown algae or Phaeophyceae. Finally the feedstock of the biomass type can also consist of macroalgae such as green algae (causing green tides), laminaria or wrack (also called kelp).

Feedstock Pretreatment

Prior to liquefaction, the feedstock can undergo one or more steps of pretreatment.

The coal optionally undergoes pretreatment for reducing its ash content; these technologies (washing, extraction, etc.) are described extensively in the literature. With or without pretreatment for ash reduction, the coal preferably undergoes a pretreatment for reducing its moisture content (drying), followed by a step for reduction of particle size (grinding). The drying step is carried out at a temperature below 250° C., preferably below 200° C., preferably for 15 to 200 minutes. The coal is then sent to a grinding mill for obtaining the desired granulometry.

After pretreatment, coal particles are obtained having a water content from 1 to 50%, preferably from 1 to 35% and more preferably from 1 to 10%, and a particle size below 600 μm, preferably below 150 μm.

In the case of co-processing with a feedstock of the biomass type, similarly, before liquefaction, the biomass can undergo one or more steps of pretreatment.

Preferably, the pretreatment comprises a step of partial reduction of the water content (or drying), followed by a step of reduction of the particle size until the size range is reached that is suitable for making up the biomass/solvent suspension for processing in liquefaction reactors. The drying step is carried out at a temperature below 250° C., preferably below 200° C., preferably for 15 to 200 minutes. The biomass is then sent to a grinding mill for obtaining the desired granulometry.

Other pretreatments, appropriate to the nature of the feedstock, can supplement or replace the drying and grinding steps, notably torrefaction in the case of lignocellulosic biomass or demineralization in the case of algae; these technologies are described extensively in the literature.

In the case of lignocellulosic biomass or a constituent thereof, the torrefaction step is carried out at a temperature between 200° C. and 300° C., preferably between 225° C. and 275° C., in the absence of air preferably for 15 to 120 minutes, to reach a water content of the biomass to be treated of about 1 to 10%, preferably between 1 and 5%. This step can replace the drying step. The grinding step is greatly facilitated by the torrefaction step, which makes it possible to reduce the energy consumption relative to grinding without prior torrefaction. The pretreatment of lignocellulosic biomass preferably comprises a treatment by torrefaction. In the case of liquefaction of lignin alone, the torrefaction step is not necessary.

After pretreatment, particles of biomass are obtained having a water content from 1 to 50%, preferably from 1 to 35% and more preferably from 1 to 10%, and a particle size below 600 μm, preferably below 150 μm.

Liquefaction (Step a)

After the optional pretreatment steps described above, the feedstock is mixed with a solvent, preferably a hydrogen-donating solvent. The coal/solvent mixture is a suspension of coal particles dispersed in said solvent, which is then sent to the liquefaction step. For making up the suspension, the particle size of the coal is below 5 mm, preferably below 1 mm, preferably below 600 μm and more preferably below 150 μm. The solvent/coal weight ratio is generally from 0.1 to 3, preferably from 0.5 to 2.

The solvent has a triple role: suspension of the feedstock upstream of the reaction zone, thus permitting its transport to the latter, then partial dissolution of the primary conversion products and transfer of hydrogen to these primary products for conversion to liquid, minimizing the amount of solid (coke) and of gas formed in said reaction zone.

The solvent can be any type of liquid hydrocarbon known by a person skilled in the art for preparation of a suspension. The solvent is preferably a hydrogen-donating solvent comprising for example tetrahydronaphthalene and/or naphtheno-aromatic molecules. In the case of co-processing with other feedstocks, the solvent can also be constituted partially or completely of a liquid co-feed, for example vegetable oils or pyrolysis oils obtained from a carbon-containing material (biomass, coal, petroleum).

According to a preferred variant, the solvent comes from a recycled fraction from the process. This fraction preferably comprises vacuum distillate, and even more preferably vacuum gas oil, obtained from separation after liquefaction. It is also possible to recycle a proportion of the atmospheric distillates such as diesel, alone or mixed with the vacuum distillate fraction.

In the present invention, the liquefaction step in the presence of hydrogen can be carried out in the presence of an ebullating-bed supported catalyst, in the presence of a catalyst dispersed in an entrained bed (also called "slurry" reactor in English terminology) or without an added catalyst (purely thermal conversion).

Preferably, the liquefaction step is carried out in the presence of an ebullating-bed supported catalyst, preferably in at least two reactors arranged in series containing an ebullating-bed supported catalyst.

As ebullating bed technology is widely known, only the main operating conditions will be examined here. Ebullating bed technologies use supported catalysts in the form of extrusions with a diameter generally of the order of 1 mm or less than 1 mm. The catalysts remain inside the reactors and are not discharged with the products.

By using preferably at least two ebullating bed reactors, it is possible to obtain products of better quality and at a higher yield, thus limiting the need for energy and for hydrogen in hydrocracking. Moreover, liquefaction in two reactors provides improved operability in terms of flexibility of the operating conditions and of the catalytic system. Operation is usually at a pressure from 15 to 25 MPa, preferably from 16 to 20 MPa, at a temperature from about 300° C. to 440° C., preferably between 325° C. and 420° C. for the first reactor and between 350° C. and 470° C., preferably between 350 and 450° C. for the second. The liquid hourly space velocity ((t of feed/h)/t of catalyst) is from 0.1 to 5 $h^{-1}$ and the amount of hydrogen mixed with the feed is usually from about 0.1 to 5 normal cubic meters ($Nm^3$) per kg of feed, preferably from about 0.1 to 3 $Nm^3$/kg, and most often from about 0.1 to about 2 $Nm^3$/kg in each reactor. After the first step, the conversion of the feed is between 30 and 100%, preferably between 50 and 99%, the conversion being defined relative to THF insolubles, for example. The conversion of the coal based on dry matter is then everything that is not THF-insoluble.

Preferably, the temperature used in the second reactor is at least about 10° C. higher than that of the reactor in the first step. The pressure of the reactor in the second step of liquefaction is generally from 0.1 to 1 MPa lower than for the reactor in the first step, to allow flow of at least a proportion of the effluent leaving the first step without pumping being required.

Optionally, the effluent obtained at the end of the first liquefaction step is submitted to separation of the light fraction, and at least some, preferably all, of the residual effluent is treated in the second liquefaction step. This separation is advantageously performed in an inter-stage separator described in U.S. Pat. No. 6,270,654 and notably makes it possible to avoid overcracking of the light fraction in the second liquefaction reactor.

It is also possible to transfer some or all of the spent catalyst withdrawn from the reactor of the first liquefaction step, operating at lower temperature, directly to the reactor of the second step, operating at higher temperature or to transfer some or all of the spent catalyst withdrawn from the reactor of the second step directly to the reactor of the first step. This cascade system is described in U.S. Pat. No. 4,816,841.

The catalysts used in ebullating-bed liquefaction are widely marketed. They are granular catalysts whose size never reaches that of the catalysts used in entrained bed systems (slurry). The catalysts are most often in the form of extrusions or beads. Typically, they contain at least one hydrogenating-dehydrogenating element deposited on an amorphous support. Generally, the supported catalyst comprises a group VIII metal selected from the group comprising Ni, Pd, Pt, Co, Rh and/or Ru, optionally a group VIB metal selected from the group Mo and/or W, on an amorphous mineral support selected from the group comprising alumina, silica, silica-aluminas, magnesia, clays and mixtures of at least two of these minerals. The total content of oxides of elements of groups VIII and VIB is often 5-40 wt % and generally 7-30 wt %. Generally, the weight ratio expressed in oxide(s) of group VI to oxide(s) of group VIII is 1-20 and most often 2-10. It is possible, for example, to use a catalyst comprising 0.5 to 10 wt % of nickel, preferably from 1 to 5 wt % of nickel (expressed as nickel oxide NiO), and from 1 to 30 wt % of molybdenum, preferably from 5 to 20 wt % of molybdenum (expressed as molybdenum oxide $MoO_3$), on a support. The catalyst can also contain phosphorus (generally less than 20 wt % and most often less than 10 wt %, expressed as phosphorus oxide $P_2O_5$).

Prior to injection of the feed, the catalysts used in the process according to the present invention are preferably submitted to a sulphurization treatment (in-situ or ex-situ).

The catalysts of the ebullating bed liquefaction steps of the present invention may be identical or different in the reactors. Preferably, the catalysts used are based on CoMo or NiMo on alumina.

BRIEF DESCRIPTION OF THE DRAWINGS

Referring to FIG. 1, which describes the process according to the invention by liquefaction in two successive ebullating bed reactors, the coal (10), preferably pretreated beforehand, and optionally pre-ground to facilitate the pretreatment, for reducing its moisture content and its ash content, is ground in the grinding mill (12) in order to produce particles of suitable size for forming a suspension and to be more reactive in the liquefaction conditions. The coal is then brought in contact with the recycled solvent (15) obtained from the process in vessel (14) to form the suspension. If required, although rarely necessary, a sulphur-containing compound for maintaining the metals of the catalyst in the form of sulphides can be injected (not shown) in the line leaving the furnace (14). The suspension is pressurized by pump (16), preheated in furnace (18), mixed with recycled hydrogen (17), heated in furnace (21), and introduced via pipeline (19) at the bottom of the first ebullating bed reactor (20) operating with ascending flow of liquid and gas and containing at least one hydroconversion catalyst. The reactor (20) usually comprises a recirculating pump (27) for keeping the catalyst in ebullating-bed conditions by continuous recycling of at least a proportion of the liquid withdrawn from the top of the reactor and reinjected at the bottom of the reactor. Hydrogen can also be introduced with the suspension in furnace (18), thus eliminating furnace (21). The hydrogen supply is supplemented with make-up hydrogen (13). Topping-up with fresh catalyst can be done at the top of the reactor (not shown). The spent catalyst can be withdrawn from the bottom of the reactor (not shown) either for disposal, or for regeneration to remove carbon and sulphur and/or to be refreshed to remove metals prior to reinjection at the top of the reactor.

Figure 1:
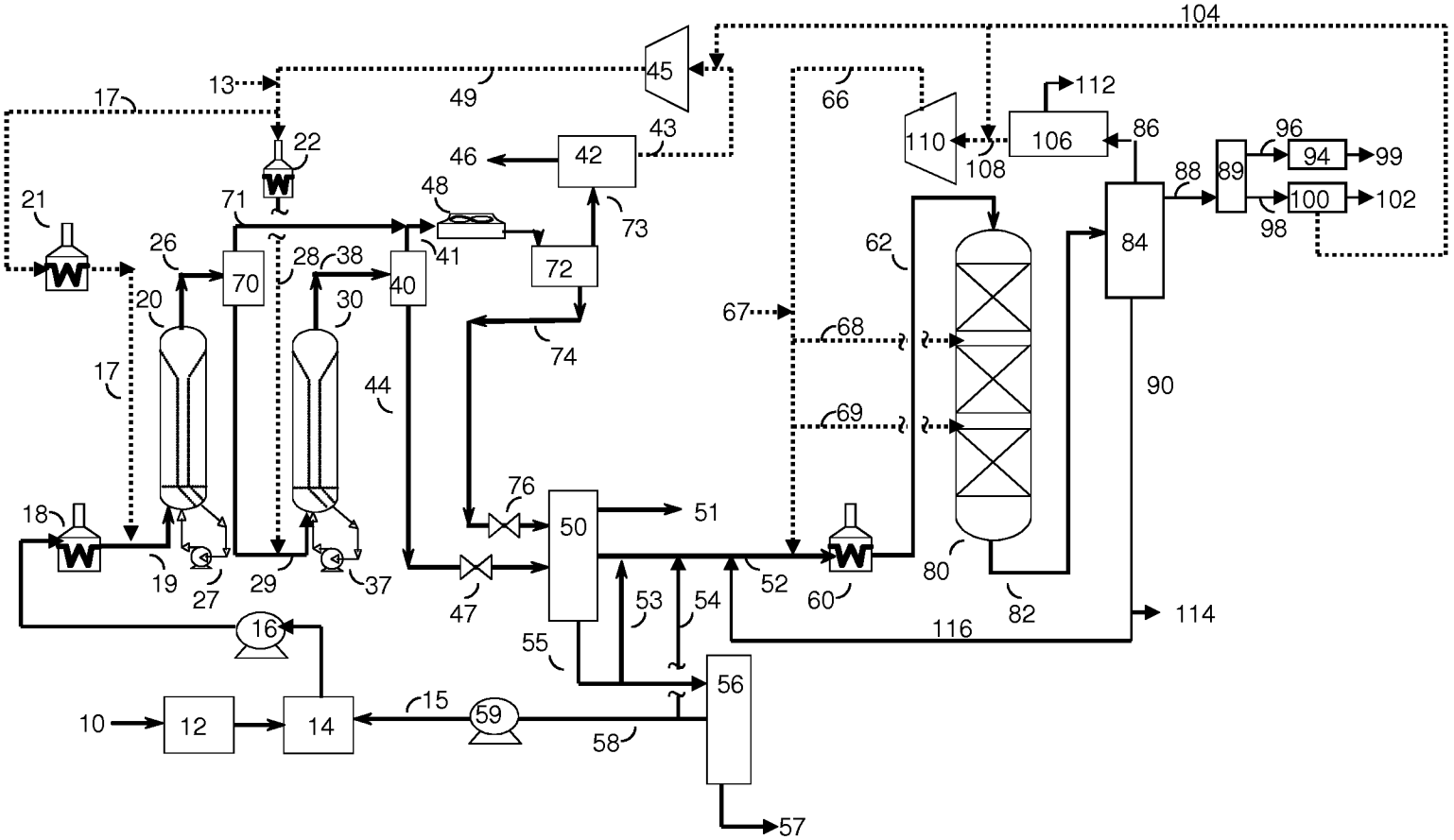
FIGS. 1 and 2 represent various embodiments of the invention.

Optionally, the converted effluent (26) from the first reactor (20) can undergo separation of the light fraction (71) in an inter-stage separator (70).

Some or all of the effluent (26) from the first liquefaction reactor (20) is advantageously mixed with additional hydrogen (28), if necessary preheated beforehand in furnace (22). This mixture is then injected via pipeline (29) into a second ebullating-bed liquefaction reactor (30) operating with ascending flow of liquid and gas containing at least one hydroconversion catalyst and operating in the same way as the first reactor. The operating conditions, notably temperature, in this reactor are selected to reach the required level of conversion, as described above. The reactor (30) usually comprises a recirculating pump (37) for keeping the catalyst in ebullating bed conditions by continuous recycling of at least a proportion of the liquid withdrawn from the top of the reactor and reinjected at the bottom of the reactor.

According to another embodiment, the liquefaction step can also be carried out in the presence of a catalyst dispersed in an entrained bed.

The technologies for liquefaction in a slurry reactor use a dispersed catalyst (also called slurry catalyst hereinafter) in the form of very small particles, with size of a few tens of microns or less (generally 0.001 to 100 μm). The catalysts, or their precursors, are injected with the feed to be converted at the inlet of the reactors. The catalysts pass through the reactors with the feed and the products undergoing conversion, then they are entrained with the reaction products out of the reactors. They are found in the heavy residual fraction after separation.

The slurry catalyst is a sulphided catalyst preferably containing at least one element selected from the group comprising Mo, Fe, Ni, W, Co, V, Ru. These catalysts are generally monometallic or bimetallic (combining for example a non-precious element of group VIIIB (Co, Ni, Fe) and a group VIB element (Mo, W)).

The catalysts used can be powders of heterogeneous solids (such as natural minerals, iron sulphate, etc.), dispersed catalysts obtained from water-soluble precursors ("water-soluble dispersed catalyst") such as phosphomolybdic acid, ammonium molybdate, or a mixture of Mo or Ni oxide with aqueous ammonia. Preferably, the catalysts used are derived from precursors that are soluble in an organic phase ("oil soluble dispersed catalyst"). The precursors are organometallic compounds such as naphthanates of Mo, of Co, of Fe, or of Ni or such as polycarbonyl compounds of these metals, for example 2-ethyl hexanoates of Mo or Ni, acetylacetonates of Mo or Ni, salts of C7-C12 fatty acids of Mo or W, etc. They can be used in the presence of a surfactant to improve dispersion of the metals, when the catalyst is bimetallic. Said precursors and catalysts usable in the process according to the invention are described extensively in the literature.

Additives can be added during preparation of the catalyst or to the slurry catalyst before it is injected into the reactor. These additives are described in the literature.

The operating conditions of the liquefaction step in a slurry reactor are identical to those described in the case of ebullating bed liquefaction.

According to another embodiment, the liquefaction step can also be carried out purely thermally (without added catalyst).

The operating conditions of the liquefaction step by the thermal route without added catalyst are identical to those described in the case of ebullating bed liquefaction.

According to a preferred variant, the liquefaction step is carried out in at least two reactors arranged in series. These reactors can contain either at least one dispersed catalyst, or at least one supported catalyst, or a mixture of dispersed and supported catalyst(s), or no added catalyst.

According to one variant, the first reactor contains a dispersed catalyst and the second reactor contains a supported catalyst.

According to another variant, the first reactor contains a supported catalyst and the second reactor contains a dispersed catalyst.

According to another variant, the first reactor does not contain any added catalyst and the second reactor contains a dispersed and/or supported catalyst.

Separation of the Effluent from Liquefaction (Step b)

The effluent obtained at the end of liquefaction is separated (generally in a high-pressure, high-temperature (HPHT) separator) into a light fraction of hydrocarbons containing compounds boiling at most at 500° C. and a residual fraction. The separation is not based on a precise cut point, rather it is akin to flash separation.

Additional separation steps can be envisaged. The separation step can advantageously be carried out by methods that are well known by a person skilled in the art, such as flash, distillation, stripping, liquid/liquid extraction etc.

Preferably, the separation is carried out in a fractionation section, which can firstly comprise an HPHT separator, and optionally a high-pressure, low-temperature (HPLT) separator, and/or an atmospheric distillation and/or a vacuum distillation.

Preferably, the separation step b) makes it possible to obtain a gas phase, at least one atmospheric distillate fraction containing naphtha, kerosene and/or diesel, a vacuum distillate fraction and a vacuum residue fraction.

At least a proportion and preferably all of the atmospheric distillate fraction, optionally supplemented with at least a proportion of the atmospheric residue fraction and/or a proportion of the vacuum distillate fraction and/or other co-feeds is sent to the hydrocracking step. The co-feed used can be vacuum distillates of petroleum origin, deasphalted oils, resins from deasphalting, derivatives from petroleum conversion processes (heavy or light oils from catalytic cracking, vacuum gas oil from a coking operation, etc.), aromatic extracts obtained from the production chains of bases for lubricants, or mixtures of these feedstocks. It is also possible to use all other types of co-feed of non-petroleum nature or of renewable nature mentioned above in the "feedstocks" paragraph.

At least a proportion and preferably all of the vacuum distillate fraction is recycled as solvent to the liquefaction step a).

The separation step b) can be carried out with or without intermediate decompression.

According to a first embodiment, the effluent from liquefaction undergoes a separation step with decompression between liquefaction and hydrocracking. This configuration can be called a non-integrated scheme and is illustrated in FIG. 1.

Referring to this figure, the effluent treated in the liquefaction reactor (30) is sent via line (38) to a high-pressure, high-temperature (HPHT) separator (40), from which a gaseous fraction (41) and a liquid fraction (44) are recovered. The gaseous fraction (41) is sent, optionally mixed with the vapour phase (71) from the optional inter-stage separator (70) between the two liquefaction reactors, generally via an exchanger (not shown) or an air cooler (48) for cooling, to a high-pressure, low-temperature (HPLT) separator (72), from which a vapour phase (73) containing the gases ($H_2$, $H_2S$, $NH_3$, $H_2O$, $CO_2$, CO, C1-C4 hydrocarbons, etc.) and a liquid phase (74) are recovered.

The vapour phase (73) from the high-pressure, low-temperature (HPLT) separator (72) is treated in the hydrogen purification unit (42), from which the hydrogen (43) is recovered for recycling via compressor (45) and line (49) to the reactors (20) and/or (30). The gases containing undesirable nitrogen, sulphur and oxygen compounds are discharged from the plant (stream (46)).

The liquid phase (74) from the high-pressure, low-temperature (HPLT) separator (72) is expanded in device (76) and then sent to the fractionation system (50).

The liquid phase (44) from high-pressure, high-temperature (HPHT) separation (40) is expanded in device (47) and then sent to the fractionation system (50). Of course, fractions (74) and (44) can be sent together, after expansion, to system (50). The fractionation system (50) typically comprises an atmospheric distillation system for producing a gaseous effluent (51), an atmospheric distillate fraction (52) and notably containing naphtha, kerosene and diesel and an atmospheric residue fraction (55). A proportion of the atmospheric residue fraction can be sent via line (53) to line (52) for treatment in the hydrocracker. Some or all of the atmospheric residue fraction (55) is sent to a vacuum distillation column (56) for recovering a vacuum residue fraction (57), unconverted coal and ash, and a vacuum distillate fraction (58) containing vacuum gas oil. The vacuum distillate fraction (58) serves at least partially as solvent for the liquefaction and is recycled after pressurization (59) via pipeline (15) to vessel (14) for mixing with the coal. A proportion of the vacuum distillate fraction (58) not used as solvent can be introduced via line (54) into line (52) for further processing in the hydrocracker (80).

Figure 2:
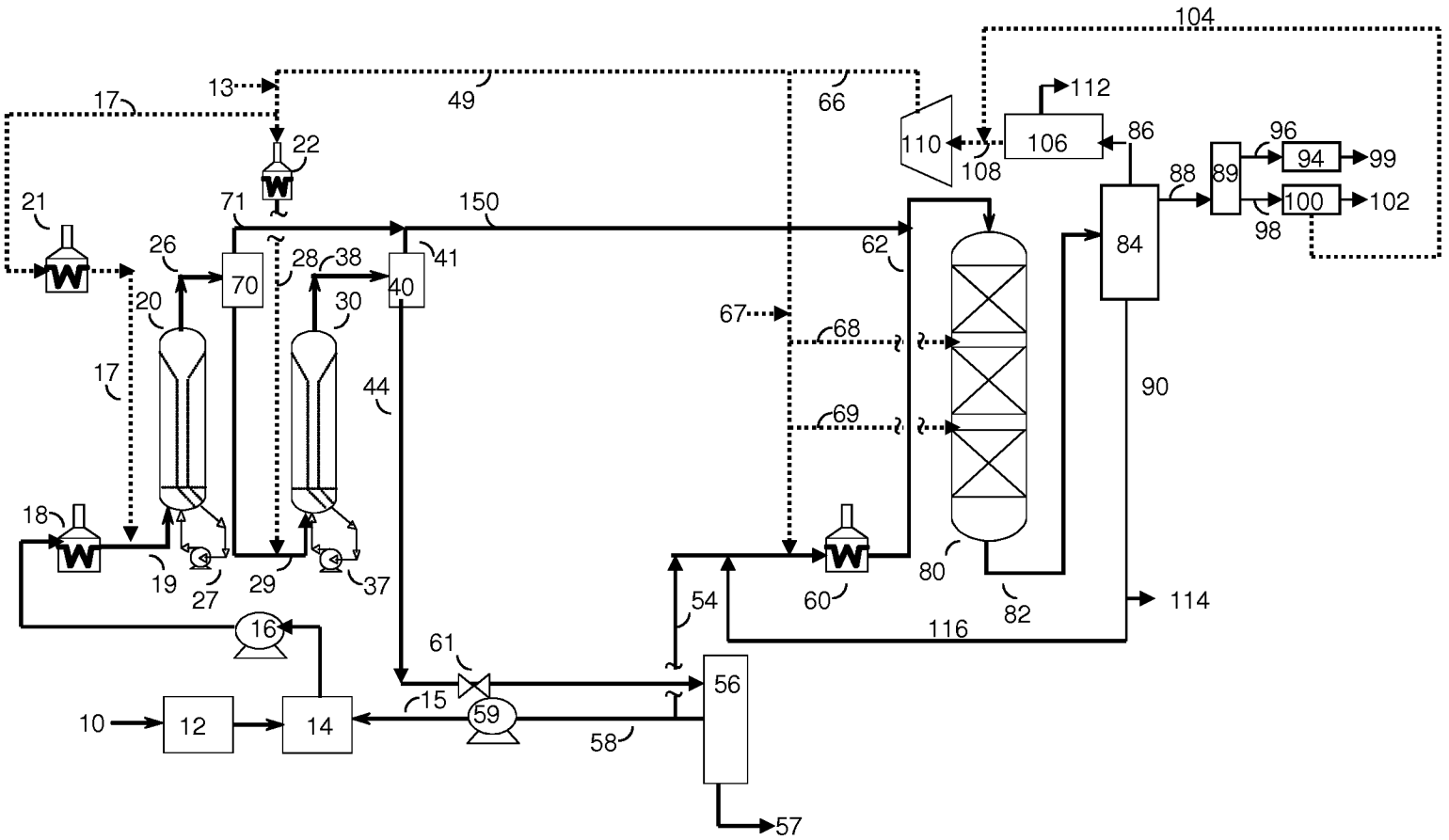

According to a second embodiment, the effluent from direct liquefaction undergoes a separation step without decompression between liquefaction and hydrocracking. This configuration can be called an integrated scheme and is illustrated in FIG. 2.

Referring to this figure, the effluent treated in the second liquefaction reactor (30) is sent via line (38) into a high-pressure, high-temperature (HPHT) separator (40), from which the so-called light fraction (41) and the residual fraction (44) are recovered. The light fraction (41) is sent directly, optionally mixed with the vapour phase (71) from the optional inter-stage separator (70) between the two reactors, via line (150) into the hydrocracking reactor.

The residual fraction (44) from high-pressure, high-temperature (HPHT) separation (40) is expanded in device (61) and then sent to the fractionation system (56). The fractionation system (56) preferably comprises a vacuum distillation system, which provides recovery of a vacuum distillate fraction containing the vacuum gas oil (58) and a vacuum residue fraction (57), unconverted coal and ash. A proportion of the vacuum distillate (58) can also be sent via line (54) for treatment in the hydrocracker. The vacuum distillate fraction (58) serves at least partially as solvent for the liquefaction and is recycled after pressurization (59) via pipeline (15) to vessel (14) for mixing with the coal.

Separation according to the integrated scheme provides better thermal integration, without recompressing the feed sent to hydrocracking and is reflected in a saving of energy and of equipment. This embodiment also makes it possible, with its simplified intermediate fractionation, to reduce the consumption of utilities and therefore the investment cost.

The light fractions from the separation steps (whether in the integrated or non-integrated scheme) preferably undergo a purification treatment for recovering the hydrogen and recycling it to the liquefaction and/or hydrocracking reactors. The gas phase from the optional inter-stage separator can also be added. Preferably the so-called incondensable gases (C1, C2) are also recovered, and can serve either as fuel used in the furnaces of the various steps of the process flowsheet, or can be sent to a steam reforming unit for making additional hydrogen, or can be sent to a steam cracking furnace for producing olefins and aromatics. Finally, preferably a C3, C4 cut is recovered, which can be sold directly as liquefied petroleum gas or can be upgraded according to the same routes as those mentioned for the incondensable gases.

Hydrocracking (Step c)

The objective of the hydrocracking step is to carry out on the one hand a quite severe hydrocracking in order to obtain a high yield of naphtha cut (and then finally of aromatic compounds and of hydrogen) and on the other hand a very deep hydrotreating to obtain a naphthenic cut that is sufficiently pure in terms of impurities so as not to poison the catalytic reforming catalysts.

"Hydrocracking" means hydrocracking reactions accompanied by hydrotreating reactions (hydrodenitrogenation, hydrodesulphurization), hydroisomerization, hydrogenation of the aromatics and opening of the naphthene rings.

The hydrocracking step according to the invention is carried out in the presence of hydrogen and a catalyst at a temperature preferably between 250 and 480° C., preferably between 320 and 450° C., very preferably between 380 and 435° C., at a pressure between 2 and 25 MPa, preferably between 3 and 20 MPa, at a space velocity between 0.1 and 20 $h^{-1}$, preferably 0.1 and 6 $h^{-1}$, preferably between 0.2 and 3 $h^{-1}$, and the amount of hydrogen introduced is such that the volume ratio of hydrogen to hydrocarbons is between 80 and 5000 $Nm^3/m^3$ and most often between 100 and 3000 $Nm^3/m^3$.

These operating conditions used in the process according to the invention generally make it possible to reach conversions per pass, to products having boiling points below 340° C., and preferably below 370° C., greater than 30 wt % and even more preferably between 50 and 100 wt %.

The hydrocracking step according to the invention can advantageously be performed in a single or, preferably, several fixed-bed catalyst beds, in one or more reactors, in a so-called one-step hydrocracking scheme, with or without intermediate separation, or alternatively, for maximizing the yield of naphtha, in a so-called two-step hydrocracking scheme, said one-step or two-step schemes operating with or without liquid recycling of the unconverted fraction, optionally in conjunction with a conventional hydrotreating catalyst located upstream of the hydrocracking catalyst. Such processes are widely known in the prior art.

The hydrocracking process can comprise a first hydrotreating step (also called hydrorefining) for reducing the content of heteroatoms before hydrocracking. Such processes are widely known in the prior art.

The hydrocracking catalysts used in the hydrocracking processes are all of the bifunctional type combining an acid function with a hydrogenating function. The acid function is supplied by the supports, the surfaces of which generally vary from 150 to 800 $m^2/g$ and display surface acidity, such as halogenated (notably chlorinated or fluorinated) aluminas, combinations of oxides of boron and of aluminium, amorphous silica-aluminas and zeolites. The hydrogenating function is supplied either by one or more metals of group VIB of the periodic table, or by a combination of at least one group VIB metal of the periodic table and at least one group VIII metal.

The catalysts can be catalysts comprising metals of group VIII, for example nickel and/or cobalt, most often in combination with at least one group VIB metal, for example molybdenum and/or tungsten. It is possible, for example, to use a catalyst comprising 0.5 to 10 wt % of nickel (expressed as nickel oxide NiO) and from 1 to 40 wt % of molybdenum, preferably from 5 to 30 wt % of molybdenum (expressed as molybdenum oxide $MoO_3$) on an acidic mineral support. The total content of oxides of metals of groups VI and VIII in the catalyst is generally between 5 and 40 wt %. The weight ratio (expressed on the basis of metal oxides) of the metal (metals) of group VI to the metal (metals) of group VIII is generally from about 20 to about 1, and most often from about 10 to about 2. In the case when the catalyst comprises at least one group VIB metal in combination with at least one non-precious metal of group VIII, said catalyst is preferably a sulphided catalyst.

Advantageously, the following combinations of metals are used: NiMo, CoMo, NiW, CoW, NiMoW and even more advantageously NiMo, NiW and NiMoW, even more preferably NiMoW.

The support will be selected for example from the group comprising alumina, silica, silica-aluminas, magnesia, clays and mixtures of at least two of these minerals. This support can also contain other compounds and for example oxides selected from boron oxide, zirconia, titanium oxide, phosphoric anhydride. A support of alumina, and preferably of η or γ alumina, is most often used.

The catalyst can also contain a promoter element such as phosphorus and/or boron. This element can have been introduced in the matrix or preferably can have been deposited on the support. Silicon can also be deposited on the support, alone or together with phosphorus and/or boron. Preferably, the catalysts contain silicon deposited on a support such as alumina, optionally with phosphorus and/or boron deposited on the support, and also containing at least one group VIII metal (Ni, Co) and at least one group VIB metal (Mo, W). The concentration of said element is usually less than 20 wt % (based on oxide) and most often less than 10%. When boron trioxide ($B_2O_3$) is present, its concentration is below 10 wt %.

Other conventional catalysts comprise zeolite Y of the FAU structural type, an amorphous refractory oxide support (most often alumina) and at least one hydrogenating-dehydrogenating element (generally at least one element of groups VIB and VIII, and most often at least one element of group VIB and at least one element of group VIII).

Other catalysts are so-called composite catalysts and comprise at least one hydrogenating-dehydrogenating element selected from the group comprising elements of group VIB and of group VIII and a support based on a silica-alumina matrix and based on at least one zeolite as described in application EP1711260.

In order to maximize the yield of hydrocracking naphtha, and then finally of aromatics after catalytic reforming of said naphtha, the hydrocracking catalyst in step c) preferably comprises a zeolite.

Prior to injection of the feed, the catalysts used in the process according to the present invention are preferably submitted to a sulphurization treatment (in-situ or ex-situ).

Referring to FIGS. 1 and 2, the light fraction from atmospheric distillation (52) according to the non-integrated scheme or from the HPHT separator (150) according to the integrated scheme and notably containing naphtha, kerosene and diesel, optionally supplemented with a proportion of the vacuum distillate (54) and/or another co-feed, is sent to the fixed-bed hydrocracking reactor (80). It is mixed with recycled hydrogen (66), optionally preheated in furnace (60) and introduced via pipeline (62) at the top of the fixed-bed hydrocracking reactor (80) operating with descending flow of liquid and of gas and containing at least one hydrocracking catalyst. The hydrogen supply is supplemented with make-up hydrogen (67). If necessary, the recycled and/or make-up hydrogen can also be introduced into the hydrocracking reactor between the different catalyst beds, for example via lines (68) and (69) (quench), in the case of a reactor with 3 catalyst beds.

Separation after Hydrocracking (Step d)

The effluent obtained at the end of the hydrocracking step undergoes at least one separation step in order to recover at least one naphtha fraction, which is then sent to catalytic reforming.

The separation step can advantageously be carried out by methods that are well known by a person skilled in the art such as flash, distillation, stripping, liquid/liquid extraction etc. It preferably comprises a fractionation section with an integrated high-pressure, high-temperature (HPHT) separator, and then atmospheric distillation.

Referring to FIG. 1, preferably the separation of the effluent (82) is carried out in a fractionation section (84) with an integrated high-pressure, high-temperature (HPHT) separator, an atmospheric distillation and optionally a vacuum distillation (not shown), which makes it possible to separate a gas phase (86), at least one naphtha fraction (88) and a fraction heavier than the naphtha fraction (90).

The gaseous fraction (86) is treated in the hydrogen purification unit (106), from which the hydrogen (108) is recovered and recycled via compressor (110) and line (66) to the hydrocracking reactors (80) and/or to the liquefaction reactors (20) and (30) (not shown). The gases containing undesirable nitrogen, sulphur and oxygen compounds are discharged from the plant (stream (112)). The incondensable gases (C1, C2) and the liquefied petroleum gas (C3, C4) can be upgraded by the same routes as those obtained from liquefaction.

According to a variant for maximizing the naphtha cut, at least a proportion of the fraction heavier than the naphtha fraction (90) is preferably recycled to the hydrocracking step c) (116). In the case of total recycling in particular, a purge (114) is provided.

According to another variant (not shown), this fraction heavier than the naphtha fraction (90) can be separated further, preferably by atmospheric distillation, to obtain at least one fraction of middle distillates (kerosene and/or diesel) and a vacuum distillate fraction containing vacuum gas oil.

According to another variant of the process (not shown), the fraction heavier than the naphtha fraction (90) can be sent at least partly to a steam cracker in order to obtain light olefins such as ethylene and/or propylene. The heavy fuel oil leaving the steam cracker, which is generally difficult to upgrade, can then advantageously be recycled for extinction to the first and/or second liquefaction reactor. It can also be sent to the coal gasification unit, if there is one, for producing hydrogen. According to this variant, the process according to the invention thus makes it possible to maximize the production of aromatics and of light olefins from coal.

The naphtha fraction (88) obtained can advantageously be separated (89) into a light naphtha fraction (C5-C6) (96) which is preferably submitted at least partly to an isomerization process (94) for producing isomerate (base for road gasoline) (99) and a heavy naphtha fraction (C7—150 to 200° C.) (98) which is submitted at least partly to the catalytic reforming step (100) for producing reformate (102) rich in aromatics. The isomerization processes are widely known in the prior art; isomerization makes it possible to transform a linear paraffin into an isomerized paraffin for the purpose of increasing its octane number.

The naphtha fraction (88) can also be sent in its entirety to the catalytic reforming, without prior separation.

Catalytic Reforming (Step e)

The naphtha fraction obtained after separation of the hydrocracking effluent has a high content of naphthenes and a very low content of impurities owing to the severe hydrocracking. It is thus a particularly suitable feedstock for catalytic reforming.

More particularly, the naphtha fraction that must be sent to catalytic reforming generally contains between 1 and 50 wt %, preferably between 5 and 30 wt % of paraffins, between 20 and 100 wt % of naphthenes, preferably between 50 and 90% and between 0 and 20 wt % of aromatics. With regard to impurities, it generally has a nitrogen content below 0.5 ppm and a sulphur content below 0.5 ppm.

Numerous chemical reactions are involved in the reforming process. They are well known; we may mention, for reactions that are beneficial to the formation of aromatics and improvement of the octane number, dehydrogenation of naphthenes, isomerization of cyclopentane rings, isomerization of paraffins, dehydrocyclization of paraffins, and for harmful reactions, hydrogenolysis and hydrocracking of paraffins and of naphthenes. Moreover, it is known that the catalytic reforming catalysts are particularly sensitive to poisoning, which can be caused by metallic impurities, sulphur, nitrogen, water and halides.

The catalytic reforming step can be carried out, according to the invention, by any of the known processes, using any of the known catalysts, and is not limited to a particular process or a particular catalyst. Numerous patents relate to reforming processes or processes for production of aromatic compounds with continuous or sequential regeneration of the catalyst.

The process flowsheets generally employ at least two reactors, in which a moving bed of catalyst circulates from top to bottom, through which a feed passes that is composed of hydrocarbons and hydrogen, the feed being heated between each reactor. Other process flowsheets use fixed-bed reactors.

The continuous process for catalytic reforming of hydrocarbons is a process that is familiar to a person skilled in the art, it employs a reaction zone having a series of 3 or 4 reactors in series, with moving-bed operation, and has a zone for catalyst regeneration, which in its turn comprises a certain number of steps, including a step of combustion of the coke deposited on the catalyst in the reaction zone, an oxychlorination step, and a final step of reduction of the catalyst with hydrogen. After the regeneration zone, the catalyst is reintroduced at the top of the first reactor of the reaction zone. This process is described for example in application FR2801604 or in FR2946660.

Processing of the feed in the reforming reactor(s) generally takes place at a pressure from 0.1 to 4 MPa and preferably from 0.3 to 1.5 MPa, at a temperature between 400 and 700° C. and preferably between 430 and 550° C., at a space velocity from 0.1 to 10 $h^{-1}$ and preferably from 1 to 4 $h^{-1}$ and with a recycled hydrogen/hydrocarbons ratio (mol.) from 0.1 to 10 and preferably between 1 and 5, and more particularly from 2 to 4 for the process for producing aromatics.

The catalyst generally comprises a support (for example formed from at least one refractory oxide, the support can also include one or more zeolites), at least one precious metal (preferably platinum), and preferably at least one promoter metal (for example tin or rhenium), at least one halogen and optionally one or more additional elements (such as alkali metals, alkaline-earth metals, lanthanides, silicon, elements of group IV B, non-precious metals, elements of group III A, etc.). These catalysts are described extensively in the literature.

Reforming makes it possible to obtain a reformate comprising at least 70% of aromatics. Conversion is generally above 80%.

The hydrogen (104) produced in the catalytic reforming step e) is preferably recycled to the liquefaction step a) and/or to the hydrocracking step c).

Separation of the Aromatic Compounds from the Reformate (Step f)

Separation of the aromatic compounds contained in the reformate can advantageously be carried out by any method known by a person skilled in the art. Preferably, it is carried out by liquid-liquid extraction, extractive distillation, adsorption and/or crystallization. These methods are known by a person skilled in the art.

Liquid-liquid extraction makes it possible to extract the aromatic compounds in the solvent constituting the extract. The paraffinic or naphthenic fractions are insoluble in the solvent. Solvents such as sulpholane, N-methyl-2-pyrrolidone (NMP) or dimethylsulphoxide (DMSO) are generally used.

The principal extractants used in extractive distillation are N-methyl-2-pyrrolidone (NMP), n-formylmorpholine (NFM) and dimethylformamide (DMF).

In this way, aromatic compounds, essentially of the BTX type (benzene, toluene, xylenes and ethylbenzene), are obtained from coal.

EXAMPLES

Example 1

Liquefaction Steps

The two liquefaction steps in ebullating bed reactors are carried out with coal of the bituminous type, ground and dried beforehand. The operating conditions for liquefaction are shown in Table 1, and the yields from liquefaction in Table 2.

TABLE 1

Operating conditions for liquefaction in two steps

| | |
|---|---|
| Catalyst | NiMo/Alumina |
| Temperature of reactor R1 (° C.) | 410 |
| Temperature of reactor R2 (° C.) | 440 |
| Pressure, MPa | 17 |
| LHSV R1 (kg/h dry coal/kg catalyst) | 1.2 |
| LHSV R2 (kg/h dry coal/kg catalyst) | 1.2 |
| $H_2$ at inlet ($Nm^3$/kg dry coal) | 2.8 |
| liquid/coal recycle | 1.1 |

TABLE 2

Yields from liquefaction in two steps
(wt %/dry coal without ash, including $H_2$ consumption)

| Products | Yields/coal (% w/w) |
|---|---|
| C1-C4 (gas) | 13.53 |
| C5-199° C. | 7.34 |
| 199-260° C. | 12.65 |
| 260-343° C. | 30.33 |
| 343-388° C. | 8.53 |
| 388-454° C. | 4.04 |
| 454-523° C. | 1.20 |
| 523° C.+ | 2.41 |
| unconverted coal | 13.23 |
| $H_2O/CO/CO_2/NH_3/H_2S$ | 13.80 |
| C5-388° C. | 58.85 |
| 200° C.+ in C5-388° C. | 51.51 |

Example 2

One-Step Hydrocracking Step HCK Max. Middle Distillate (HCK0) (not According to the Invention)

This example is an example of a base with max. fuels used when one wishes to maximize the yield of middle distillate (kerosene and diesel), the gasoline being sent a priori to further catalytic reforming for producing from it both fuel and aromatic bases BTX for chemistry. It is not optimized for producing a maximum of gasoline and therefore also for producing a maximum of aromatics.

The distillation cuts C5-199° C., 199-260° C., 260-343° C. and 343-388° C. obtained at outlet from liquefaction (Table 2), representing a yield of 58.85% w/w based on dry coal without ash, are sent as a mixture (designated C5-388° C.) to hydrocracking. The part of the heavy fraction that is not recycled, the unconverted coal and the ash are sent to gasification for production of $H_2$. The operating conditions for hydrocracking are shown in Table 3, and the yields from hydrocracking in Table 4.

TABLE 3

| Operating conditions for hydrocracking HCK0 | |
|---|---|
| Catalyst | NiW/Silica-Alumina |
| Pressure, MPa | 16 |
| Temperature (° C.) | 392 |
| LHSV ($Nm^3$/h C5-388° C./$m^3$ of catalyst) | 0.5 |
| $H_2$/HC reactor inlet ($Nm^3$/h $H_2$/$Nm^3$ C5-388° C.) | 1300 |
| Recycling of residual fraction | no |

TABLE 4

| Yields from hydrocracking HCK0 (wt %/based on dry coal without ash, including $H_2$ consumption) | |
|---|---|
| Products | Yields/dry coal (% w/w) |
| $H_2S/NH_3/H_2O$ | 1.00 |
| C1-C4 | 0.45 |
| C5-200° C. | 11.83 |
| 200-250° C. | 14.78 |
| 250-350° C. | 30.77 |
| 350° C.+ | 1.47 |
| 200° C.+ | 47.02 |
| Net conversion of 200° C.+/ liquefied product | 9% |

Table 5 gives the physicochemical properties of the wide naphtha cut C5-200° C. of the hydrocracked effluent from liquefied product from coal, as well as the properties of the wide gas oil cut 200° C.+ (base for jet fuel and diesel fuel).

TABLE 5

Physicochemical properties of the HCK0 cuts (wt %/liquefied product at inlet C5-388° C., including $H_2$ consumption)

| Cut/method of analysis | Units | naphtha | gas oil | Method |
|---|---|---|---|---|
| Cut point | ° C. | C5-200 | 200+ | |
| Yield | % w/w | 20.11 | 79.89 | ASTM D2892 |
| Density at 15° C. | g/$cm^3$ | 0.825 | 0.880 | NF EN ISO 12185 |
| Hydrogen NMR | % w/w | 13.70 | 13.35 | ASTM D7171 |
| Nitrogen | ppm w/w | <0.3 | 0.4 | ASTM4629 |
| Sulphur (UV) | ppm w/w | <0.5 | 5 | ASTM D2622 or NF EN ISO 20884 |
| Flow point | ° C. | | −24 | ASTM D97 |
| RON/MON CFR | | 56/53 | | ASTM D2699/D2700 |
| Cetane number CFR | | | 51 | ASTM D613/86 |
| DS 0.5% | | 73 | 173 | ASTM D2887 |
| DS 5% | | 86 | 213 | |
| DS 50% | ° C. | 142 | 265 | |
| DS 95% | | 195 | 350 | |
| DS 99.5% | | 209 | 430 | |
| n-Paraffins | % w/w | 6.0 | 6.2 | GC*GC IFPEN |
| iso Paraffins | % w/w | 7.0 | 4.5 | |
| Naphthenes | % w/w | 78.6 | 85.0 | |
| Monoaromatics | % w/w | 5.7 | 2.7 | |
| Diaromatics | % w/w | 2.7 | 1.6 | |

Example 3

One-Step Hydrocracking Step HCK (HCK1) (According to the Invention)

This example is an example in one-step max. gasoline hydrocracking mode without recycling of the hydrocracked residual fraction to the hydrocracking inlet, the hydrocracked naphtha being sent to catalytic reforming for essentially producing BTX aromatics for chemistry.

The feed sent to hydrocracking is the same as for example 2: C5-388° C. cut representing a yield of 58.85% w/w based on dry coal and without ash. The operating conditions for hydrocracking are shown in Table 6, the yields from hydrocracking in Table 7.

TABLE 6

| Operating conditions for hydrocracking HCK1 | |
|---|---|
| Catalyst | NiW/Silica-Alumina |
| Pressure, MPa | 16 |
| Temperature (° C.) | 410 |
| LHSV ($Nm^3$/h C5-388° C./$m^3$ of catalyst) | 0.33 |
| $H_2$/HC reactor inlet ($Nm^3$/h $H_2$/$Nm^3$ C5-388° C.) | 2600 |
| Recycling of residual fraction | no |

TABLE 7

| Yields from hydrocracking HCK1 (wt %/based on dry coal without ash, including $H_2$ consumption) | |
|---|---|
| Products | Yields/dry coal (% w/w) |
| $H_2S/NH_3/H_2O$ | 1.01 |
| C1-C4 | 2.42 |
| C5-200° C. | 23.37 |
| 200-250° C. | 15.16 |
| 250-350° C. | 18.12 |
| 350° C.+ | 0.86 |
| 200° C.+ | 34.14 |
| Net conversion of 200° C.+/ liquefied product | 34% |

Table 8 gives the physicochemical properties of the wide naphtha cut C5-200° C. of the hydrocracked effluent ex-liquefied product from coal as well as the properties of the wide gas oil cut 200° C.+ (base for jet fuel and diesel fuel).

TABLE 8

Physicochemical properties of the HCK1 cuts (wt %/liquefied product at inlet C5-388° C., including $H_2$ consumption)

| Cut/method of analysis | Units | naphtha | gas oil | Method |
|---|---|---|---|---|
| Cut point | ° C. | C5-200 | 200+ | |
| Yield | % w/w | 40.63 | 59.37 | ASTM D2892 |
| Density at 15° C. | g/$cm^3$ | 0.813 | 0.857 | NF EN ISO 12185 |
| Hydrogen NMR | % w/w | 13.80 | 13.45 | ASTM D7171 |
| Nitrogen | ppm w/w | <0.3 | 0.5 | ASTM4629 |
| Sulphur (UV) | ppm w/w | <0.5 | <5 | ASTM D2622 or NF EN ISO 20884 |
| Flow point | ° C. | | <−48 | ASTM D97 |
| RON/MON CFR | | 55/52 | | ASTM D2699/D2700 |
| Cetane number CFR | | | 52 | ASTM D613/86 |
| DS 0.5% | | 70 | 193 | ASTM D2887 |
| DS 5% | | 83 | 209 | |
| DS 50% | ° C. | 140 | 254 | |
| DS 95% | | 194 | 322 | |
| DS 99.5% | | 208 | 371 | |
| n-Paraffins | % w/w | 4.9 | 6.5 | GC*GC IFPEN |
| iso Paraffins | % w/w | 6.1 | 7.0 | |
| Naphthenes | % w/w | 85.7 | 83.5 | |
| Monoaromatics | % w/w | 3.0 | 2.5 | |
| Diaromatics | % w/w | 0.3 | 0.5 | |

Example 4

Two-Step Hydrocracking Step (HCK2) (According to the Invention)

This example is an example in two-step max. gasoline hydrocracking mode with recycling of the hydrocracked residual fraction 250° C.+ to the hydrocracking inlet, the hydrocracked naphtha being sent to catalytic reforming essentially for making BTX aromatics for chemistry.

The feed sent to hydrocracking is the same as for example 2: the C5I-388° C. cut representing a yield of 58.85% w/w based on dry coal and without ash. The operating conditions for hydrocracking are shown in Table 9, and the yields from hydrocracking in Table 10.

TABLE 9

Operating conditions for hydrocracking HCK2

| | |
|---|---|
| Catalyst | NiW/Silica-Alumina + zeolite |
| Pressure, MPa | 16 |
| Temperature (° C.) | 390 |
| LHSV ($Nm^3$/h C5-388° C./$m^3$ of catalyst) | 0.33 |
| $H_2$/HC reactor inlet ($Nm^3$/h $H_2$/$Nm^3$ C5-388° C.) | 1300 |
| Recycling of residual fraction | yes (250° C.+) |

TABLE 10

Yields from hydrocracking HCK1 (wt %/based on dry coal without ash, including $H_2$ consumption)

| Products | Yields/dry coal (% w/w) |
|---|---|
| $H_2S/NH_3/H_2O$ | 1.01 |
| C1-C4 | 8.16 |
| C5-200° C. | 43.56 |
| 200-250° C. | 8.77 |
| 250° C. | 0 |
| 200° C.+ | 8.77 |
| Net conversion of the 200° C.+/ liquefied product | 83% |

Table 11 gives the physicochemical properties of the wide naphtha cut C5-200° C. of the hydrocracked effluent ex-liquefied product from coal as well as the properties of the wide gas oil cut 200° C.+.

TABLE 11

Physicochemical properties of the HCK2 cuts

| Cut/method of analysis | Units | naphtha | gas oil | Method |
|---|---|---|---|---|
| Cut point | ° C. | C5-200 | 200+ | |
| Yield | % w/w | 83.23 | 16.77 | ASTM D2892 |
| Density at 15° C. | g/$cm^3$ | 0.780 | 0.840 | NF EN ISO 12185 |
| Hydrogen NMR | % w/w | 14.4 | 14.0 | ASTM D7171 |
| Nitrogen | ppm w/w | <0.3 | 0.5 | ASTM4629 |
| Sulphur (UV) | ppm w/w | <0.5 | <2 | ASTM D2622 or NF EN ISO 20884 |
| Flow point | ° C. | | <−48 | ASTM D97 |
| RON/MON CFR | | 59/56 | | ASTM D2699/D2700 |
| Point of disappearance of crystals | ° C. | | −66 | ASTM D7153 |

TABLE 11-continued

Physicochemical properties of the HCK2 cuts

| Cut/method of analysis | Units | naphtha | gas oil | Method |
|---|---|---|---|---|
| Cetane number CFR | | | 49 | ASTM D613/86 |
| Smoke point | mm | | 24 | ISO 3014 |
| DS 0.5% | | 50 | 180 | ASTM D2887 |
| DS 5% | | 67 | 209 | |
| DS 50% | ° C. | 132 | 220 | |
| DS 95% | | 192 | 252 | |
| DS 99.5% | | 205 | 260 | |
| n-Paraffins | % w/w | 6.9 | 4.5 | GC*GC IFPEN |
| iso Paraffins | % w/w | 11.4 | 7.0 | |
| Naphthenes | % w/w | 80.7 | 86.5 | |
| Monoaromatics | % w/w | 1 | 2.0 | |
| Diaromatics | % w/w | 0 | 0 | |

Example 5

Catalytic Reforming of Naphthas from Hydrocracking to Aromatics (HCK0, HCK1 and HCK2)

Table 12 shows the balances obtained in reforming naphtha C5-200° C. in max. aromatics mode obtained from examples 3 (HCK1) and 4 (HCK2) relative to the max. middle distillates mode example 2 (HCK0).

The typical conditions used in reforming are quite mild relative to the petroleum naphthas that are far less rich in naphthenes: 450 to 460° C. for a level of RON equivalent to 104 (max. aromatics mode), a molar ratio $H_2$/HC of 4 and a space velocity by weight (SVW) of 2.5 $h^{-1}$.

It can thus be seen that in the max. gasoline modes (HCK1 and HCK2), and bearing in mind that C9 and C7 can be transformed to C8 via the complex aromatics chain, it is possible to obtain very high yields by weight of C6-C8 aromatics relative to the initial coal based on dry matter, up to about 15% in one-step mode and up to about 27.5% in two-step mode.

TABLE 12

Yields from reforming of naphtha C5-200° C. ex hydrocracking

| Yield/coal % w/w | case HCK 1 step (HCK0) max. middle distillates mode | case HCK 1 step (HCK1) max. gasoline mode | case HCK 2 steps (HCK2) max. gasoline mode |
|---|---|---|---|
| C5+ | 11.22 | 22.09 | 40.67 |
| $H_2$ | 0.47 | 1.03 | 1.91 |
| C1 + C2 | 0.04 | 0.08 | 0.33 |
| C3 + C4 | 0.09 | 0.17 | 0.72 |
| Benzene (C6) | 0.88 | 2.05 | 3.76 |
| Toluene (C7) | 2.29 | 5.36 | 9.80 |
| C8 Aromatics (1) | 2.01 | 4.43 | 8.08 |
| C9 Aromatics | 2.39 | 3.99 | 7.48 |
| C10 Aromatics | 1.77 | 2.28 | 4.06 |
| Total C6-C9 Aromatics | 7.58 | 15.83 | 29.12 |

approximate distribution of C8 aromatics: 30% ethylbenzene, 35% meta-xylene, 15% para-xylene and 20% ortho-xylene Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications, cited herein and of corresponding French application Ser. No. 11/03.757, filed Dec. 7, 2011, and French application Ser. No. 11/03.753, filed Dec. 7, 2011, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for conversion of coal to aromatic compounds, comprising:

a) liquifying coal in the presence of hydrogen, b) separating effluent obtained at the end of a) into a light fraction of hydrocarbons containing compounds boiling at most at 500° C. and a residual fraction, c) hydrocracking at least a proportion of said light fraction of hydrocarbons obtained at the end of step b) in the presence of hydrogen in at least one reactor containing a fixed-bed hydrocracking catalyst, with a conversion of 200° C.+ fraction being greater than 30 wt %, d) separating effluent obtained at the end of step c) into at least a naphtha fraction containing between 1-50% wt % paraffins, 20-99 wt % naphthenes, a nitrogen content below 0.5 ppm and a sulphur content below 0.5 and a fraction heavier than the naphtha fraction, e) catalytic reforming the fraction containing naphtha, without pretreatment, giving hydrogen and a reformate containing aromatic compounds, f) separation of aromatic compounds from the reformate.

2. The process according to claim 1, in which liquefaction a) in the presence of hydrogen is carried out in the presence of an ebullating-bed supported catalyst, in the presence of a catalyst dispersed in an entrained bed or without catalyst added.

3. The process according to claim 1 in which liquefaction a) is carried out in at least two reactors arranged in series each containing an ebullating-bed supported catalyst.

4. The process according to claim 1 in which liquefaction a) operates at a temperature between 300° C. and 440° C. in a first reactor and a temperature between 350° C. and 470° C. in a second reactor, then at a pressure between 15 and 25 MPa, at a liquid hourly space velocity ((t of feed/h)/t of catalyst) between 0.1 and 5 $h^{-1}$ and at a hydrogen/feed ratio between 0.1 and 5 $Nm^3/kg$ in each reactor.

5. The process according to claim 1 in which hydrocracking c) operates at a temperature between 250 and 480° C., at a pressure between 2 and 25 MPa, at a space velocity between 0.1 and 20 $h^{-1}$ and the amount of hydrogen introduced is such that the volume ratio of hydrogen to hydrocarbons is between 80 and 5000 $Nm^3/m^3$.

6. The process according to claim 1 in which hydrocracking catalyst in c) comprises a zeolite.

7. The process according to claim 1 in which catalytic reforming operates at a pressure from 0.1 to 4 MPa, at a temperature between 400 and 700° C., at a space velocity from 0.1 to 10 $h^{-1}$ and with a recycled hydrogen/hydrocarbons ratio (mol.) from 0.1 to 10.

8. The process according to claim 1 in which hydrogen produced in catalytic reforming e) is recycled to the liquefaction a) and/or to hydrocracking c).

9. The process according to claim 1 in which separation b) makes it possible to obtain a gas phase, at least one atmospheric distillate fraction containing naphtha, kerosene and/or diesel, a vacuum distillate fraction and a vacuum residue fraction.

10. The process according to claim 9 in which at least a proportion of the atmospheric distillate fraction, optionally supplemented with at least a proportion of the vacuum distillate fraction and/or of other co-feeds, is sent to hydrocracking c) and at least a proportion of the vacuum distillate fraction is recycled as solvent to liquefaction a).

11. A process for conversion of coal to aromatic compounds, comprising:

a) liquifying coal in the presence of hydrogen, b) separating effluent obtained at the end of a) into a light fraction of hydrocarbons containing compounds boiling at most at 500° C. and a residual fraction, c) hydrocracking at least a proportion of said light fraction of hydrocarbons obtained at the end of step b) in the presence of hydrogen in at least one reactor containing a fixed-bed hydrocracking catalyst, with a conversion of 200° C.+ fraction being greater than 30 wt %, d) separating effluent obtained at the end of step c) into at least a naphtha fraction containing 1-50% wt % paraffins, 20-99 wt % naphthenes, a nitrogen content below 0.5 ppm and a sulphur content below 0.5 and a fraction heavier than the naphtha fraction, e) the fraction containing naphtha from step d) is separated into a light naphtha fraction and a heavy naphtha fraction, the light naphtha fraction is submitted at least partly to an isomerization process, the heavy naphtha fraction is submitted at least partly to catalytic reforming step f)

f) catalytic reforming the fraction containing naphtha, giving hydrogen and a reformate containing aromatic compounds, g) separation of aromatic compounds from the reformate.

12. The process according to claim 1 in which the heavier fraction that is heavier than the naphtha fraction obtained in d) is at least partly recycled to hydrocracking c).

13. The process according to claim 1 in which the heavier fraction that is heavier than the naphtha fraction obtained in d) is at least partly sent to a steam cracker in order to obtain light olefins.

14. The process according to claim 1 in which separating the aromatic compounds from the reformate is carried out by liquid-liquid extraction, extractive distillation, adsorption and/or crystallization.

15. The process according to claim 1 in which said coal is co-processed with a feedstock of petroleum residue, vacuum distillate of petroleum origin, crude oil, synthetic crude, topped crude, deasphalted oil, resin from deasphalting, asphalt or tar from deasphalting, a petroleum conversion process product, aromatic extract obtained from production chains of bases for lubricants, bituminous sand or a derivative thereof, oil shale or a derivative thereof, waste hydrocarbon and/or industrial polymer, organic waste or household plastic, vegetable or animal oil, fat, tar, or residue that cannot be upgraded or are difficult to upgrade obtained from gasification and/or Fischer-Tropsch synthesis of biomass, coal or petroleum residue, lignocellulosic biomass or one or more constituents of cellulosic biomass selected from the group consisting of cellulose, hemicellulose and/or lignin, algae, charcoal, oil from pyrolysis of lignocellulosic biomass or of algae, pyrolytic lignin, a product from hydrothermal conversion of lignocellulosic biomass or of algae, activated sludge from water treatment works, or mixtures of these feedstocks.

* * * * *